US011035263B2

(12) United States Patent
Geckler et al.

(10) Patent No.: US 11,035,263 B2
(45) Date of Patent: Jun. 15, 2021

(54) COMPRESSION RELEASE VALVETRAIN DESIGN

(71) Applicant: Cummins Inc., Columbus, IN (US)

(72) Inventors: Samuel C. Geckler, Columbus, IN (US); Vivek Anand Sujan, Columbus, IN (US); Adam C. Cecil, Columbus, IN (US); Anthony Kyle Perfetto, Columbus, IN (US)

(73) Assignee: Cummins Inc., Columbus, IN (US)

( * ) Notice: Subject to any disclaimer, the term of this patent is extended or adjusted under 35 U.S.C. 154(b) by 0 days.

(21) Appl. No.: 16/424,891

(22) Filed: May 29, 2019

(65) Prior Publication Data

US 2019/0277205 A1 Sep. 12, 2019

Related U.S. Application Data

(63) Continuation of application No. PCT/US2017/063940, filed on Nov. 30, 2017.

(60) Provisional application No. 62/427,902, filed on Nov. 30, 2016.

(51) Int. Cl.
*F01L 13/00* (2006.01)
*F01L 1/344* (2006.01)
(Continued)

(52) U.S. Cl.
CPC ..... *F01L 13/0036* (2013.01); *F01L 1/181* (2013.01); *F01L 1/267* (2013.01); *F01L 1/344* (2013.01); *F01L 13/065* (2013.01); *F01L 13/085* (2013.01); *F02D 9/06* (2013.01); *F02D 13/0242* (2013.01); *F02D 13/04* (2013.01);
(Continued)

(58) Field of Classification Search
None
See application file for complete search history.

(56) References Cited

U.S. PATENT DOCUMENTS 4,414,935 A * 11/1983 Curtis ..... F01L 13/0005 123/198 F
4,936,273 A 6/1990 Myers
(Continued)

FOREIGN PATENT DOCUMENTS

DE 102007038078 2/2009
DE 102014008378 12/2015
(Continued)

OTHER PUBLICATIONS

Search Report and Written Opinion, PCT Appln. No. PCT/US17/63940, dated Feb. 15, 2018, 10 pgs.
(Continued)

*Primary Examiner* — Patrick Hamo
*Assistant Examiner* — Wesley G Harris
(74) *Attorney, Agent, or Firm* — Taft Stettinius & Hollister LLP

(57) ABSTRACT

Systems, apparatuses and methods are disclosed that include an internal combustion engine including a plurality of cylinders operable by a valve actuation mechanism including a lifting mechanism having a compression brake valve profile configured to selectively lift the exhaust valves on a downstroke of the cylinders in response to a cranking condition of the internal combustion engine, wherein the compression braking valve profile is phased to the upstroke of the pistons.

8 Claims, 6 Drawing Sheets

(51) Int. Cl.

| | |
|---|---|
| ***F02D 13/02*** | (2006.01) |
| ***F01L 13/08*** | (2006.01) |
| ***F02D 9/06*** | (2006.01) |
| ***F01L 1/26*** | (2006.01) |
| ***F01L 13/06*** | (2006.01) |
| ***F01L 1/18*** | (2006.01) |
| ***F02D 13/04*** | (2006.01) |
| *F01L 1/047* | (2006.01) |
| *F01L 1/053* | (2006.01) |
| *F01L 1/20* | (2006.01) |
| *F01L 1/08* | (2006.01) |
| *F01L 9/20* | (2021.01) |

(52) U.S. Cl.

CPC ..... *F01L 1/08* (2013.01); *F01L 1/185* (2013.01); *F01L 1/20* (2013.01); *F01L 9/20* (2021.01); *F01L 2001/0473* (2013.01); *F01L 2001/0537* (2013.01); *F01L 2001/186* (2013.01); *F01L 2001/34433* (2013.01); *F01L 2305/00* (2020.05); *F01L 2820/01* (2013.01); *F01L 2820/041* (2013.01); *F01L 2820/044* (2013.01)

(56) References Cited

U.S. PATENT DOCUMENTS

| | | | | |
|---|---|---|---|---|
| 5,197,422 | A | 3/1993 | Oleksy et al. | |
| 5,711,264 | A | 1/1998 | Jezek et al. | |
| 6,553,962 | B1 * | 4/2003 | Russ et al. | F02D 13/04 123/322 |
| 6,725,821 | B2 | 4/2004 | Warren et al. | |
| 6,951,198 | B1 | 10/2005 | Megli et al. | |
| 7,162,998 | B1 | 1/2007 | Bartlett et al. | |
| 7,263,960 | B2 | 9/2007 | Saito et al. | |
| 8,230,837 | B2 | 7/2012 | Hergert et al. | |
| 8,468,988 | B2 | 6/2013 | Nishikiori et al. | |
| 2002/0148426 | A1 | 10/2002 | Billetdeaux | |
| 2003/0183185 | A1 * | 10/2003 | Sun | F01L 9/02 123/179.16 |
| 2004/0065308 | A1 | 4/2004 | Bryant | |
| 2005/0205049 | A1 | 9/2005 | Lewis | |
| 2006/0272607 | A1 | 12/2006 | Grybush | |
| 2007/0023213 | A1 * | 2/2007 | Hughes | B60W 10/06 180/65.31 |
| 2008/0006231 | A1 | 1/2008 | Noss et al. | |
| 2014/0096743 | A1 | 4/2014 | Meacham | |
| 2018/0142585 | A1 | 5/2018 | Lahr | |

FOREIGN PATENT DOCUMENTS

| | | |
|---|---|---|
| EP | 2079904 | 7/2009 |
| JP | 62108505 | 7/1987 |
| WO | 2014100185 | 6/2014 |

OTHER PUBLICATIONS

Partial EP Search Report, EP Appln. No. 17876010.4, dated Jul. 2, 2020, 12 pgs.

* cited by examiner

COMPRESSION RELEASE VALVETRAIN DESIGN

CROSS-REFERENCE TO RELATED APPLICATION

The present application is a continuation of International Patent Application No. PCT/US17/063940 filed on Nov. 30, 2017, which claims the benefit of the filing date of U.S. Provisional App. Ser. No. 62/427,902 filed on Nov. 30, 2016, which are each incorporated herein by reference.

TECHNICAL FIELD

The present disclosure relates generally to low speed engine cranking, and more particularly but not exclusively to a combination of a motor generator and a valvetrain system for implementing a compression release during engine cranking.

BACKGROUND

A motor generator has been added to an engine to replace an alternator for purposes of achieving a regenerative engine braking and a torque application to a crankshaft of the engine. More particularly, an addition of a motor generator to an engine architecture facilitates a removal of a standard low speed starter from the engine. However, a gear ratio between the motor generator and the engine for an effective brake regeneration requires a very large motor generator to crank the engine at low engine speed. As such, the most common approach is to either add a very large motor generator with a high cost and long payback period or to add a smaller motor generator while keeping a low speed starter for starting. Therefore, further improvements in engine cranking involving a motor generator is needed.

SUMMARY

The present disclosure describes systems, apparatuses and methods are disclosed that include an internal combustion engine including a plurality of cylinders operable by a valve actuation mechanism including a lifting mechanism having a compression brake valve profile configured to selectively lift the exhaust valves on a downstroke of the cylinders in response to a cranking condition of the internal combustion engine, wherein the compression braking valve profile is phased to the upstroke of the pistons.

This summary is provided to introduce a selection of concepts that are further described below in the illustrative embodiments. This summary is not intended to identify key or essential features of the claimed subject matter, nor is it intended to be used as an aid in limiting the scope of the claimed subject matter. Further embodiments, forms, objects, features, advantages, aspects, and benefits shall become apparent from the following description and drawings.

DESCRIPTION OF ILLUSTRATIVE EMBODIMENTS

Figure 1:
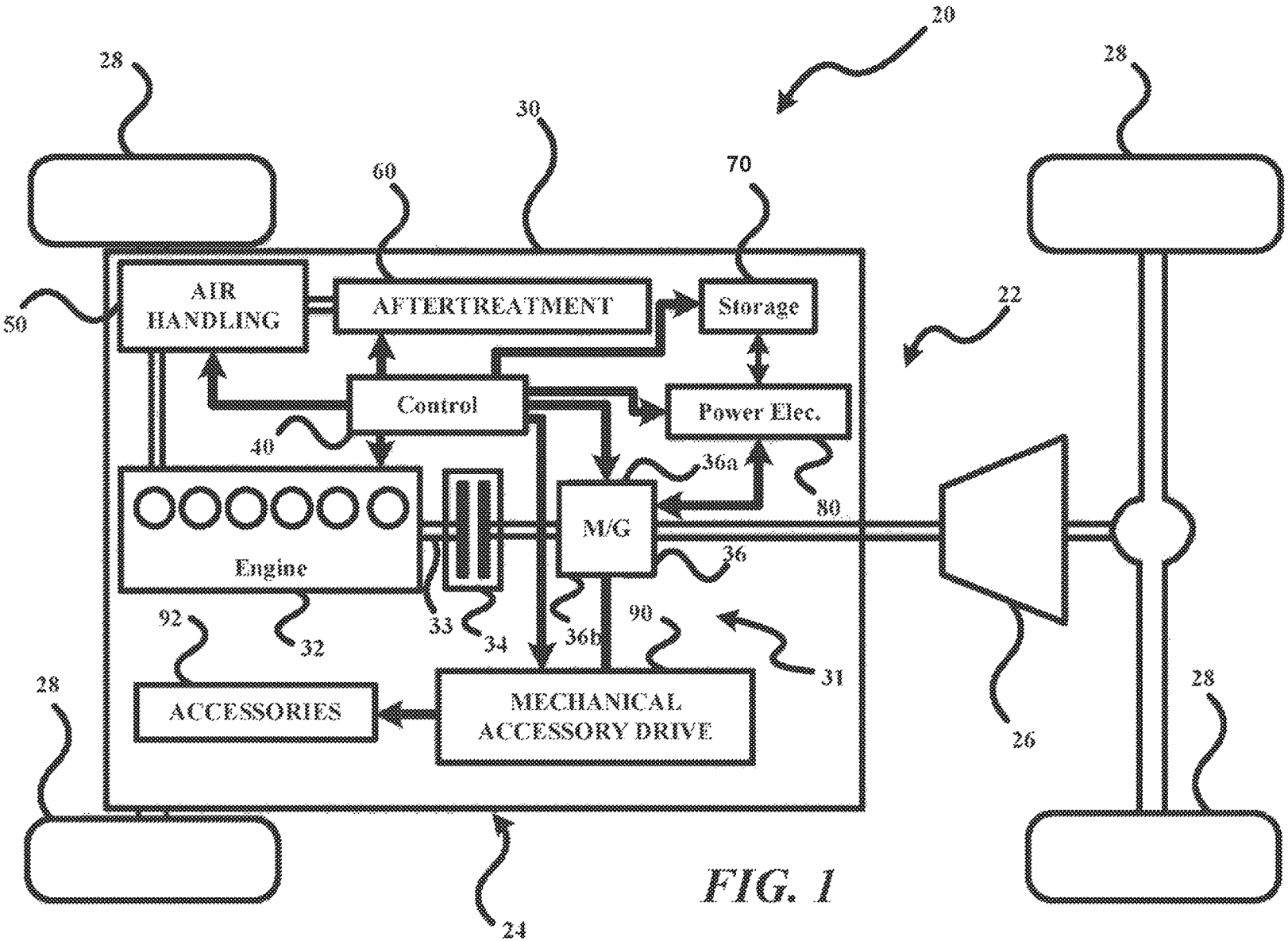
FIG. 1 illustrates a partially diagrammatic view of a vehicle including an example hybrid powertrain.

For the purposes of promoting an understanding of the principles of the invention, reference will now be made to the embodiments illustrated in the drawings and specific language will be used to describe the same. It will nevertheless be understood that no limitation of the scope of the invention is thereby intended, any alterations and further modifications in the illustrated embodiments, and any further applications of the principles of the invention as illustrated therein as would normally occur to one skilled in the art to which the invention relates are contemplated herein.

The present disclosure is directed to reducing a torque required to turn an engine during cranking. Generally, the engine torque can be reduced during cranking by using a valvetrain design that can selectively open intake valve(s) and/or exhaust valve(s) during an upstroke of a piston to reduce the work used to compress gas within cylinders. Once the engine achieves an appropriate speed whereby a motor generator is capable of maintaining a cranking speed with gas compression load, then a compression event should be initiated and combustion started on the appropriate compression cycle. The combination of a valvetrain which can release compression and a motor generator facilitates removal of a low speed starter.

More particularly, embodiments of the present disclosure can achieve the compression release result.

One embodiment involves a utilization of a specific valve event whereby a valve activation mechanism is operated to switch between a compression release event and a normal valve event.

A second embodiment involves a combination of an exhaust brake event with a camshaft phaser to move the exhaust brake event to a compression stroke rather than a normal compression stroke for the braking event. This embodiment designates the "Park" position of the phaser in alignment with a compression release phasing whereby no system response is required during cranking to allow for compression release.

A third embodiment involves a valve actuation mechanism holding all valves closed during cranking whereby an air spring trapped in a cylinder balances the compression work with the expansion work.

With reference to FIG. 1 there is illustrated a partially diagrammatic view of a vehicle 20 including an example hybrid powertrain 22. It shall be appreciated that the configuration and components of vehicle 20 and of hybrid powertrain 22 are but one example, and that this disclosure contemplates that a variety of different hybrid vehicles and hybrid powertrain configurations and components may be utilized. Hybrid powertrain 22 includes a hybrid pretransmission hybrid system 24, a transmission 26, and ground engaging wheels 28. Depicted within hybrid powertrain 22 systems is a series-parallel hybrid (selectable with clutch 34), although the system may be, without limitation, a parallel configuration, a series configuration, and/or a series-parallel hybrid system.

It should be appreciated that in this embodiment, the propulsion of vehicle 20 is provided by the rear wheels 28;

however in other applications front wheel drive and four/all wheel drive approaches are contemplated. In one form vehicle 20 is an on-road bus, delivery truck, service truck or the like; however in other forms vehicle 20 may be of a different type, including other types of on-road or off-road vehicles. In still other embodiments it may be a marine vehicle (boat/ship) or other vehicle type. In yet other embodiments, rather than a vehicle, the hybrid power train 22, including the pretransmission hybrid power system 24 is applied to stationary applications, such as an engine-driven generator (a Genset), a hybrid system-driven pump, or the like to name just a few possibilities.

Pretransmission hybrid system 24 includes hybrid power system 30. System 30 includes internal combustion engine 32, clutch 34, motor/generator 36, controller 40, air handling subsystem 50, aftertreatment equipment 60, electrical power storage device 70, electrical power electronics device 80, and mechanical accessory drive subsystem 90. System 30 is in the form of a parallel hybrid power source 31 such that engine 32 and/or motor/generator 36 can provide torque for power train 22 depending on whether clutch 34 is engaged or not. It should be appreciated that motor/generator 36 can operate as a motor 36*a* powered by electricity from storage device 70, or as an electric power generator 36*b* that captures electric energy. In other operating conditions, the motor/generator may be passive such that it is not operating at all. In the depicted form, motor/generator 36 has a common rotor 37*a* and a common stator 37*b*, and is provided as an integrated unit; however in other embodiments a completely or partially separate motor, generator, rotor, stator, or the like may be employed. The designated motor/generator 36 is intended to encompass such variations. Furthermore it should be appreciated that in alternative embodiments of system 30 some of these features, such as air handling subsystem 50, aftertreatment equipment 60, and/or mechanical accessory drive 90 may be absent and/or other optional devices/subsystems may be included (not shown).

In certain embodiments the motor/generator 36 may comprise a hydraulic or pneumatic pump rather than an electric motor/generator. It shall be appreciated that references to a motor/generator herein are intended to encompass both electric motor/generators and non-electric motor/generators such as those comprising hydraulic or pneumatic pumps. Furthermore, power storage device 70 of system 30 may comprise one or more electrochemical batteries, supercapacitors or ultracapacitors, or may alternatively store energy in a different, non-electrical medium such as an accumulator found in a hydraulic or pneumatic hybrid system. It shall be appreciated that references to a battery herein are intended to encompass electrochemical storage batteries, other electrical storage devices such as capacitors, and non-electrical energy storage devices such as accumulators utilized in hydraulic or pneumatic hybrid systems.

In the illustrated embodiment, engine 32 is of a four-stroke, diesel-fueled, Compression Ignition (CI) type with multiple cylinders and corresponding reciprocating pistons coupled to crankshaft 33, which typically would be coupled to a flywheel. Crankshaft 33 is mechanically coupled to controllable clutch 34. Engine 32 may be of a conventional type with operation modifications to complement operation in system 30. In other embodiments, engine 32 may be of a different type, including different fueling, different operating cycle(s), different ignition, or the like.

Vehicle 20 further includes a controller 40 which may be configured to control various operational aspects of vehicle 20 and hybrid powertrain 22 as described in further detail herein. Controller 40 may be implemented in any of a number of ways. Controller 40 executes operating logic that defines various control, management, and/or regulation functions. This operating logic may be in the form of one or more microcontroller or microprocessor routines stored in a non-transitory memory, dedicated hardware, such as a hard-wired state machine, analog calculating machine, various types of programming instructions, and/or a different form as would occur to those skilled in the art.

Controller 40 may be provided as a single component, or a collection of operatively coupled components; and may comprise digital circuitry, analog circuitry, or a hybrid combination of both of these types. When of a multi-component form, controller 40 may have one or more components remotely located relative to the others in a distributed arrangement. Controller 40 can include multiple processing units arranged to operate independently, in a pipeline processing arrangement, in a parallel processing arrangement, or the like. In one embodiment, controller 40 includes several programmable microprocessing units of a solid-state, integrated circuit type that are disturbed throughout system 30 that each include one or more processing units and non-transitory memory. For the depicted embodiment, controller 40 includes a computer network interface to facilitate communications using standard Controller Area Network (CAN) communications or the like among various system control units. It should be appreciated that the depicted modules or other organizational units of controller 40 refer to certain operating logic performing indicated operations that may each be implemented in a physically separate controller of controller 40 and/or may be virtually implemented in the same controller.

The description herein including modules and/or organizational units emphasizes the structural independence of the aspects of the controller, and illustrates one grouping of operations and responsibilities of the controller. Other groupings that execute similar overall operations are understood within the scope of the present application. Modules and/or organizational units may be implemented in hardware and/or as computer instructions on a non-transient computer readable storage medium, and may be distributed across various hardware or computer based components.

Example and non-limiting implementation elements of modules and/or organizational units of the controller 40 include sensors providing any value determined herein, sensors providing any value that is a precursor to a value determined herein, datalink and/or network hardware including communication chips, oscillating crystals, communication links, cables, twisted pair wiring, coaxial wiring, shielded wiring, transmitters, receivers, and/or transceivers, logic circuits, hard-wired logic circuits, reconfigurable logic circuits in a particular non-transient state configured according to the module specification, any actuator including at least an electrical, hydraulic, or pneumatic actuator, a solenoid, an op-amp, analog control elements (springs, filters, integrators, adders, dividers, gain elements), and/or digital control elements.

Controller 40 and/or any of its constituent processors/controllers may include one or more signal conditioners, modulators, demodulators, Arithmetic Logic Units (ALUs), Central Processing Units (CPUs), limiters, oscillators, control clocks, amplifiers, signal conditioners, filters, format converters, communication ports, clamps, delay devices, memory devices, Analog to Digital (A/D) converters, Digital to Analog (D/A) converters, and/or different circuitry or functional components as would occur to those skilled in the art to perform the desired communications.

Controller 40 may be configured to perform a number of example control processes in which a total power and a power-split allocation can be determined and utilized in controlling one or more systems of hybrid powertrain 22 or vehicle 20. Controller 40 may be configured to implement unique methodologies and processes for controlling hybrid vehicles and hybrid powertrains, including basic vehicle control, power-split optimization and energy management, and hardware protection. In certain example embodiments, controller 40 may be configured to manage two principal quantities independently. The first managed quantity is the total power demanded of the powertrain (Pd) which may be determined, for example, using accelerator position, a throttle torque table, idle speed governor, PTO speed governor, cruise control governor, torque limiters, and any other information or criteria useful for engine and vehicle control.

Figure 2:
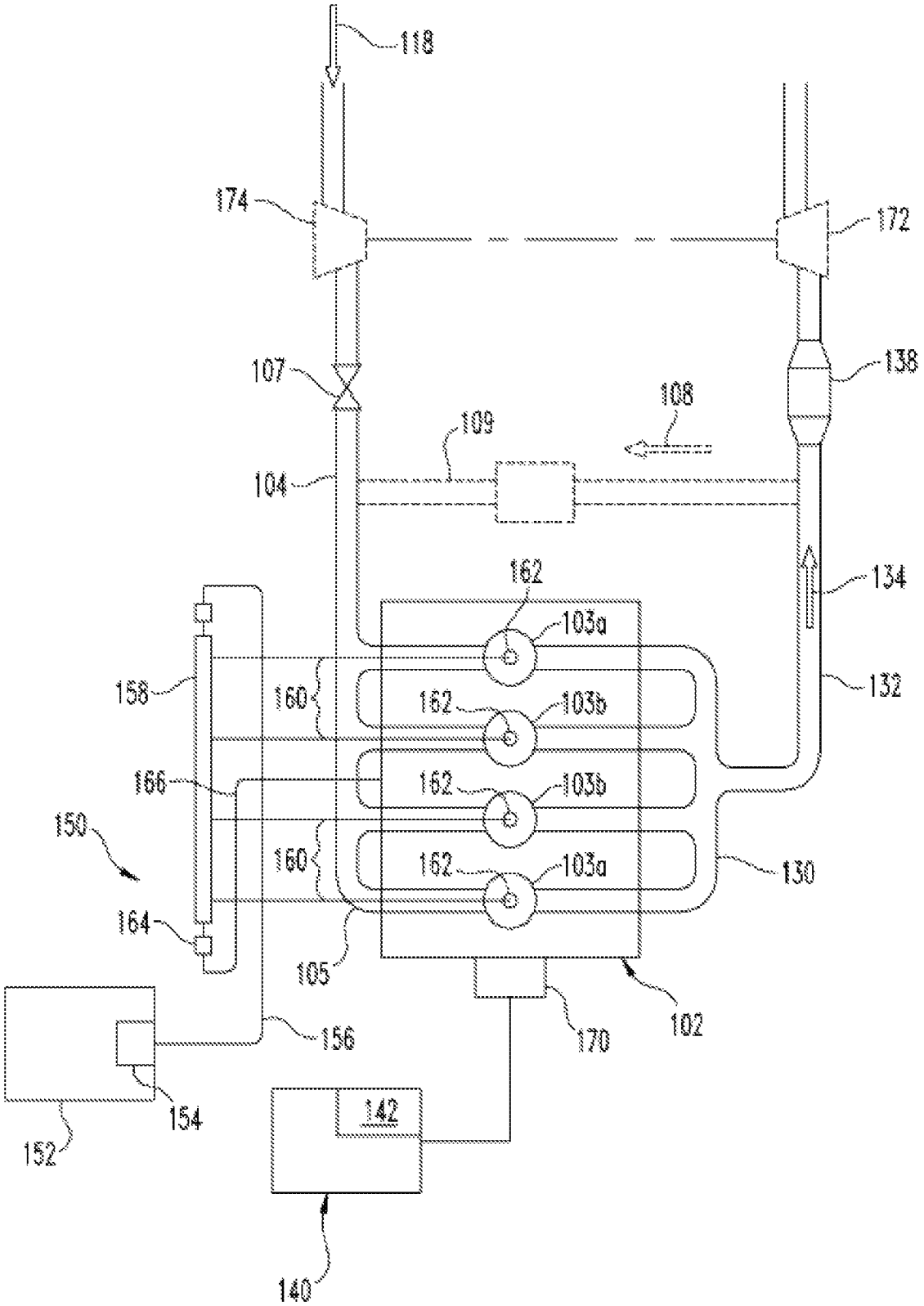
FIG. 2 is a schematic depiction of a system having an internal combustion engine.

Referencing FIG. 2, one embodiment 100 of engine 32 (FIG. 1) is an internal combustion engine 102 of any type, and can include a stoichiometric engine, a diesel engine, a gasoline engine, an ethanol engine, and/or a natural gas engine. In certain embodiments, the engine 102 includes a lean combustion engine such as a lean burn gasoline engine, or a diesel cycle engine. In certain embodiments, the engine 102 may be any engine type producing emissions that may include an exhaust gas recirculation (EGR) system, for example to reduce $NO_x$ emissions from the engine 102. The engine 102 includes a number of cylinders 103*a*, 103*b* (collectively referred to as cylinders 103.) The number of cylinders 103 may be any number suitable for an engine.

In the illustrated embodiment of FIG. 2, another embodiment system 100 includes an engine 102 having an inline 4 cylinder arrangement for illustration purposes, but V-shaped arrangements and other cylinder numbers are also contemplated. The engine 102 includes cylinders 103, which are operated with a nominal valve lift profile under normal operating conditions of engine 102 and which are operated with a compression brake profile in response to cranking conditions of engine 102 as will be further described herein.

Figure 3:
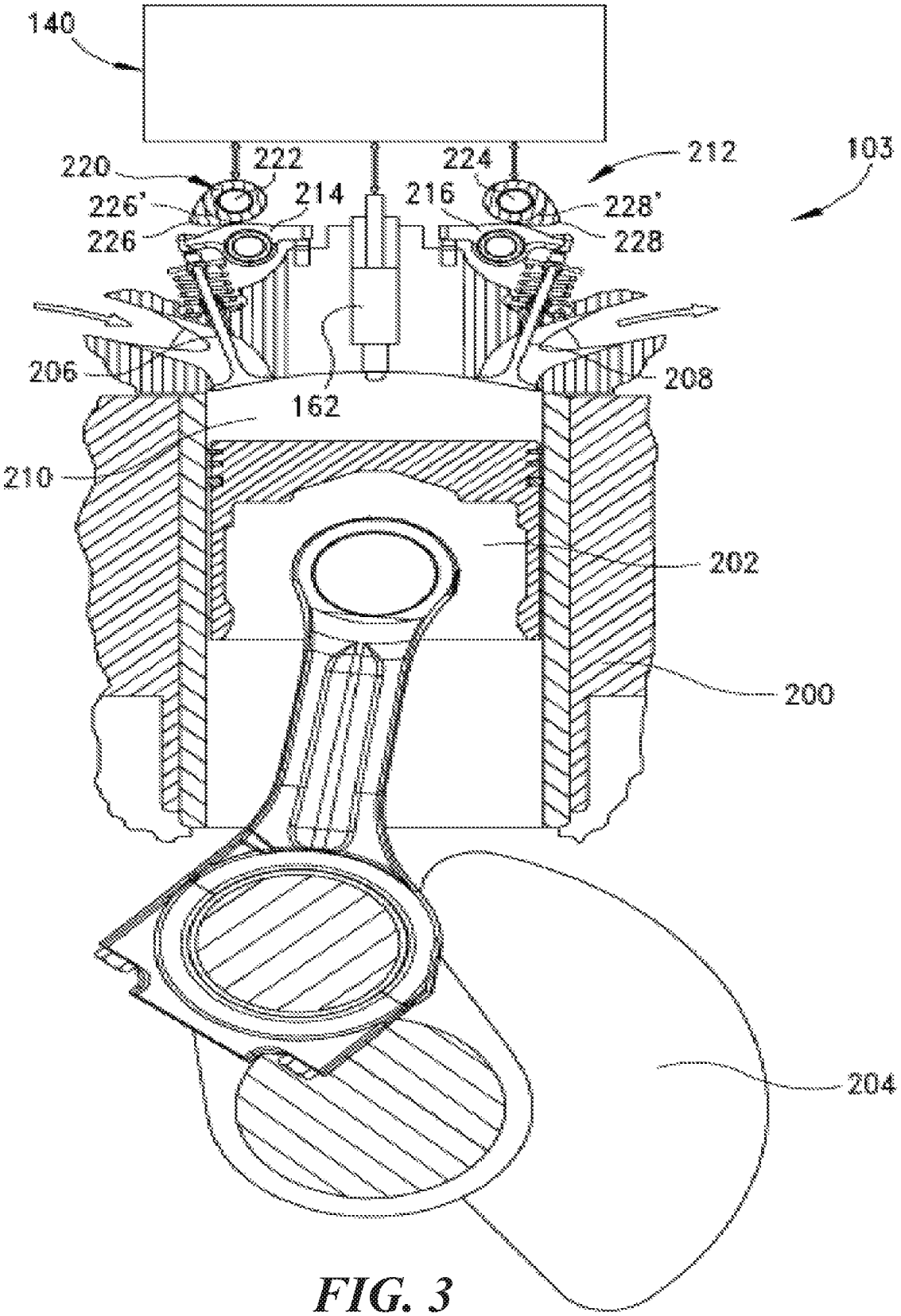
FIG. 3 is a schematic cross-section of a cylinder and valve actuation mechanism.

A typical multi-cylinder engine 102 (or engine 32) has an engine block 200 with multiple cylinders 103, and, as shown in FIG. 3, a piston 202 in each cylinder that is operably attached to a crankshaft 204. There is also at least one intake valve 206 and at least one exhaust valve 208 that allow passage of air into and out of each cylinder 103. A combustion chamber 210 is formed inside each cylinder. The typical engine 102 operates on a four-stroke cycle that sequentially includes an air intake stroke, a compression stroke, a power stroke, and an exhaust stroke. As used herein, one cycle of the cylinder or engine occurs at the completion of these four strokes.

Figure 4:
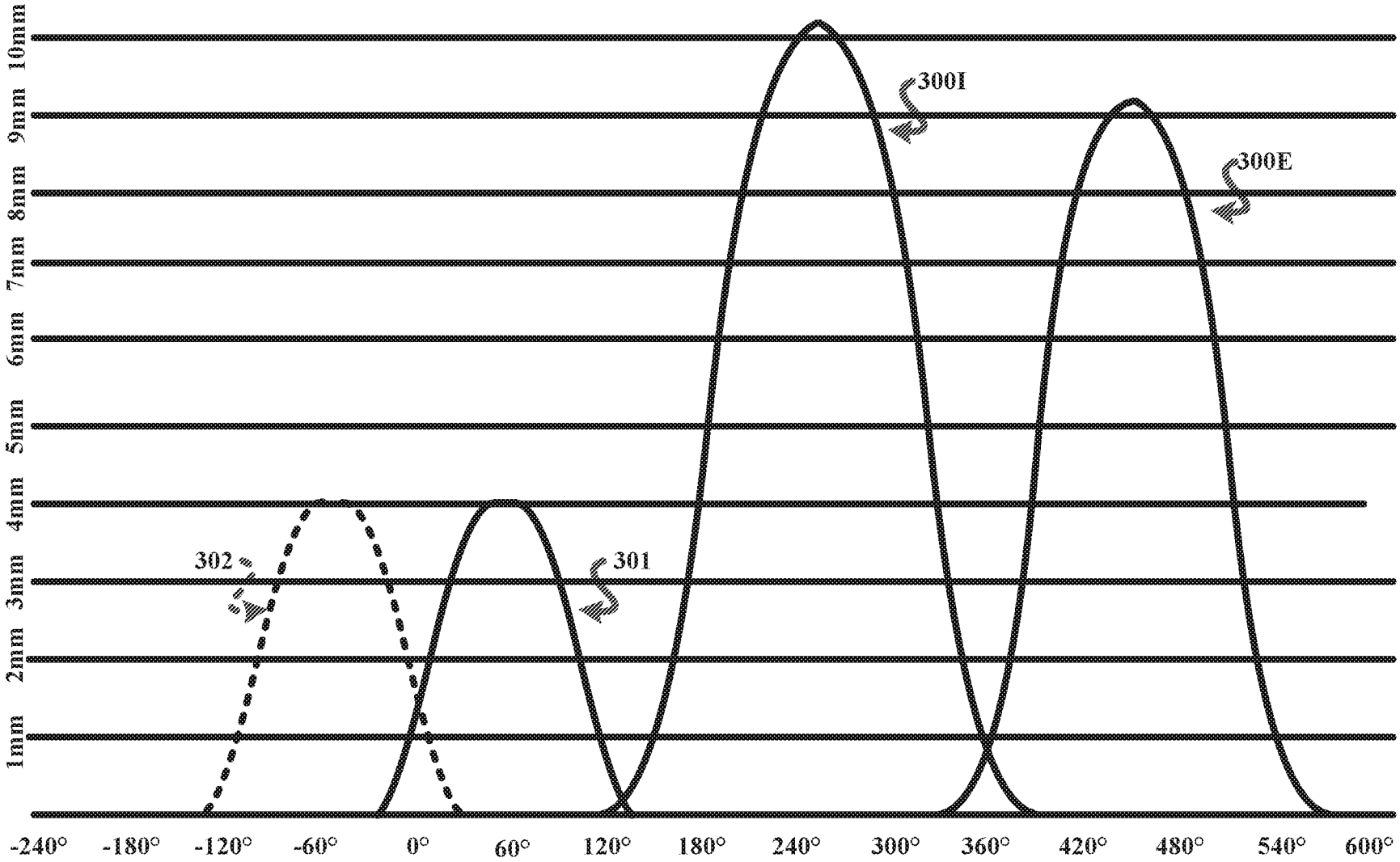
FIG. 4 is a graph of nominal lift profiles and compression brake profiles.

The present system 10 or 100 includes a valve actuation mechanism 220 that is configured to provide a nominal intake valve lift profile for opening and closing intake valve 206 of each cylinder 103 in response to nominal engine operation conditions. The exhaust valve(s) of each cylinder can also be opened and closed with a nominal exhaust valve lift profile that is the same or different from that of the nominal intake valve lift profile that opens and closes the intake valves 206. FIG. 4 illustrates an exemplary nominal intake valve lift profile 300I and an exemplary nominal exhaust valve lift profile 300E.

Referring back to FIG. 3, valve actuation mechanism 220 is further configured for switching to a compression brake profile for operation of intake valves 206 and exhaust valves 208 in response to a cranking condition of engine 102. FIG. 4 illustrates an exemplary compression braking profile 301 for operation of exhaust valves 208 in response to a cranking condition of engine 102.

Valve actuation mechanism 220 includes hardware mounted in a head 212 of engine 102 and control algorithms that are internal to the controller 140. The cylinder hardware includes a valve opening mechanism 214, 216 for respective ones of intake and exhaust valves 206, 208 of each cylinder 103. The valve actuation mechanism 220 also comprises a hydraulic subsystem (not shown) that supplies pressurized oil from an engine oil pump (not shown) to each valve opening mechanism 214, 216. In one embodiment, the valve opening mechanism 214, 216 is comprised of a lifter and a locking pin mechanism that is inserted between the camshaft 222, 224 and the respective valves 206, 208.

A typical valve train is comprised of the camshafts 222, 224. The plurality of valves 206, 208 are normally closed to a zero lift position against their respective valve seats and are spring-mounted in the head 212. The valve train is operable to open the plurality of exhaust valves 208, the plurality of intake valves 206, or both, depending upon the engine design. Each camshaft 222, 224 is a long rod that is mounted in the engine 102 and rotates around its longitudinal axis. Each camshaft 222, 224 has cam lobes 226, 228, respectively, that correspond to and operate each valve 206, 208. Cam lobes 226, 228 are typically cut into the respective camshaft 222, 224 such that they are eccentric to the axis of rotation of the respective camshaft 222, 224.

In practice, while preferred, a physical camshaft is not required for the implementation of the compression brake profiles of the present disclosure. Alternatively, the exhaust values may be lifted by an electrical control implementation as known in the art.

Each lobe 226, 228 has an eccentric portion and a portion that is concentric to the longitudinal axis of the cam shaft. The concentric portion is defined by and can be referred to as the cam base circle, and the eccentric portion projects from the base circle to define a non-zero-lift profile to open and close the respective valve 206, 208 for a specified lift and duration from its valve seat. For example, the intake valve cam lobe 226 can define a nominal lift profile 300 as shown in FIG. 4. Each lobe 226, 228 is in physical contact with a respective one of the valve opening mechanisms 214, 216, which are each comprised of a lifter and a locking pin mechanism. The valve opening mechanisms 214, 216 are in physical contact with a respective one of the valves 206, 208. The rotation of the camshaft 222, 224 causes respective valve 206, 208 to open according a non-zero lift profile defined by the corresponding lobe 226, 228 when the position of the respective camshaft 222, 224 is such that the eccentric portion of its corresponding lobe 226, 228 is in contact with the adjacent valve opening mechanism 214, 216.

For cylinders 103, such as shown in FIG. 2, the valve actuation mechanism 220 is operable to operate each intake valve 206 and each exhaust valve 208 in response to an engine cranking condition. Similarly, camshaft 222 is switchable to place a third cam lobe 228' to operate the exhaust valves 208 of the cylinders 103 in accordance with compression brake profile 301 (FIG. 4) that again defines a low lift, short duration profile for opening exhaust valves 208 of the cylinders 103.

Figure 5:
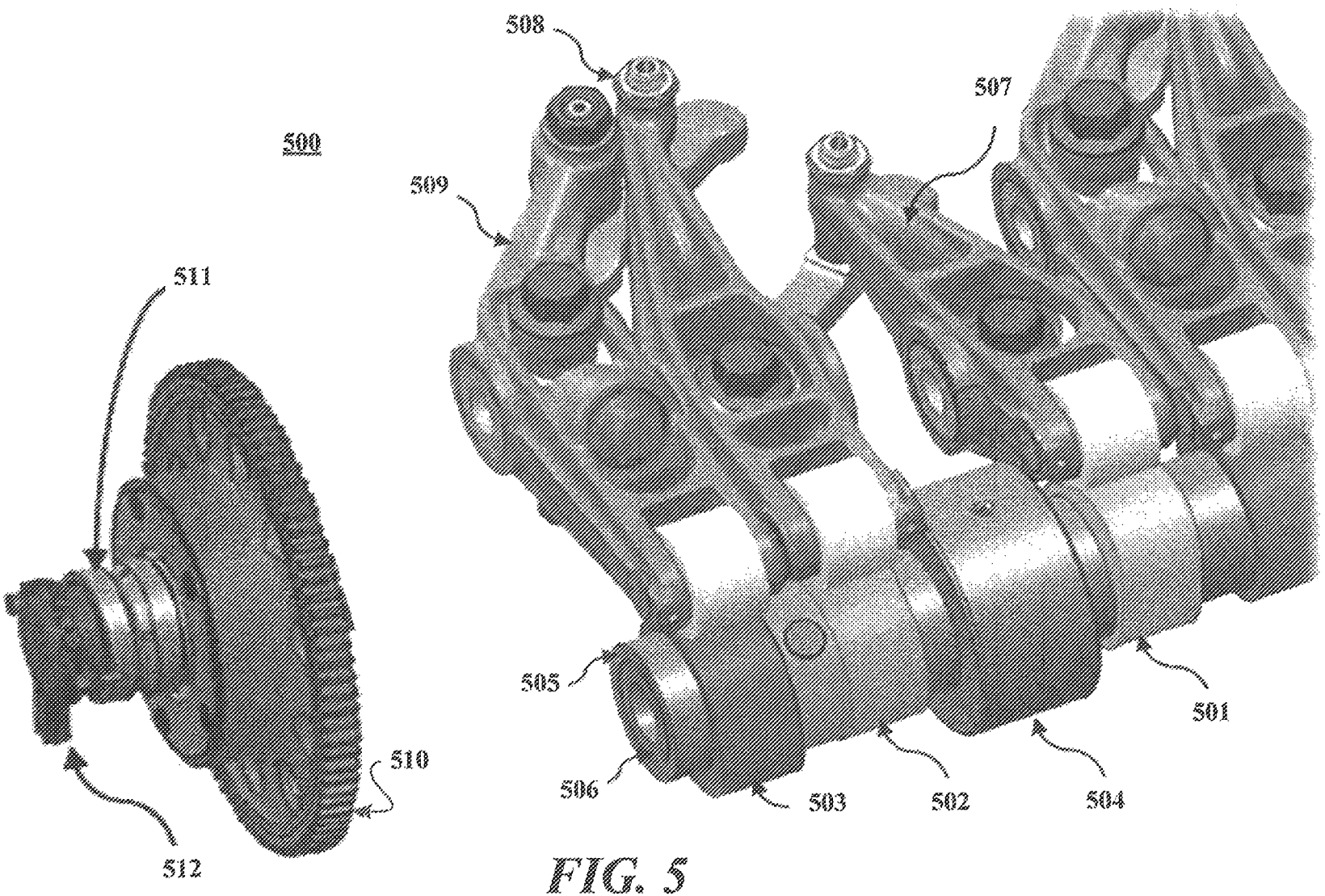
FIG. 5 illustrates a partially diagrammatic view of a concentric camshaft.

The present disclosure is also applicable to single cam shaft embodiments, such as, for example as shown in FIG. 5, a valve train assembly 500 utilizes a concentric camshaft constructed of intake camshaft lobe(s) 501, exhaust camshaft lobe(s) 502, dedicated compression release brake lobe(s) 503, camshaft bearings 504, an outer tube 505 and an inner tube or shaft 506. The intake rocker lever(s) 507 follow the intake camshaft lobe(s) 501, the exhaust rocker lever(s) 508 follow the exhaust camshaft lobe 502, and the dedicated compression release brake lever(s) 509 follow the dedicated compression release brake lobe(s) 503. The rocker levers 507-509 actuate the intake and exhaust valves not shown accordingly. An exhaust camshaft phaser 510, shown with a front camshaft bearing 511 and an actuator 512, is used to control the phase angle of the exhaust camshaft lobes(s) 502 and the compression release brake lobe(s) 503 independently of the intake camshaft lobe(s) 501, which are not phased and remain in sync with the engine's traditional camshaft drive mechanism. Described another way, the outer tube 505 is at a fixed and constant phase angle with the engine's traditional camshaft drive mechanism while the inner tube or shaft 506 can vary in phase angle with respect to the engine's traditional camshaft drive mechanism.

Further embodiments for switching between camshaft lobes are described in U.S. Application No. 62/561,771 entitled "SWITCHING TAPPET FOR COMPRESSION RELEASE BRAKING", filed Sep. 22, 2017, the entirety of which is hereby incorporated by reference.

Exhaust camshaft lobes 502 and intake exhaust camshaft lobes 501 have a nominal lift profile, such as for example, nominal lift profiles 300E and 300I shown in FIG. 4. Compression release brake lobes 503 have a compression brake relief profile 301.

Referring back to FIG. 2, in the system 100 exhaust flow 134 produced by cylinders 103 is provided to an exhaust manifold 130 and outlet to an exhaust passage 132. System 100 may include an exhaust gas recirculation (EGR) passage 109 to provide an EGR flow 108 that combines with an intake flow 118 at a position upstream of an intake manifold 105. Intake manifold 105 provides a charge flow including the intake flow 118 and, if provided, with EGR flow 108 to cylinders 103. Intake manifold 105 is connected to an intake passage 104 that includes an intake throttle 107 to regulate the charge flow to cylinders 103. Intake passage 104 may also include a charge air cooler (not shown) to cool the charge flow provided to intake manifold 105. Intake passage 104 may also include an optional compressor 170 to compress the intake air flow received from an intake air cleaner (not shown.)

The EGR flow 108 may combine with the intake flow 118 at an outlet of EGR passage 109, at a mixer, or by any other arrangement. In certain embodiments, the EGR flow 108 returns to the intake manifold 105 directly. In the illustrated embodiment, EGR flow 108 mixes with the intake flow 118 downstream of throttle 107 so that exhaust pressure on cylinders 103 is closely aligned with intake pressure, which reduces pumping losses through cylinders 103. In other embodiments, EGR passage 109 can include an EGR cooler (not shown) and a bypass (not shown) with a valve that selectively allows EGR flow to bypass the EGR cooler. The presence of an EGR cooler and/or an EGR cooler bypass is optional and non-limiting.

Cylinders 103 are connected to an exhaust system that includes an exhaust manifold 130 that receives exhaust gases in the form of exhaust flow 134 from cylinders 103 and an exhaust passage 132 that receives exhaust gas from exhaust manifold 130. In other embodiments, a turbine 172 in exhaust passage 132 is provided that is operable via the exhaust gases to drive a compressor 174 in intake passage 104. Exhaust passage 132 includes an aftertreatment system 138 in exhaust passage 132 that is configured to treat emissions in the exhaust gas. In one embodiment, aftertreatment system 138 includes a catalyst, such as a selective catalytic reduction catalyst or a three-way catalyst. Other embodiments contemplate an exhaust throttle (not shown) in the exhaust passage 132.

System 100 further includes a fuel system 150 that is operable to provide fuel from a fuel storage source 152, such as a fuel tank, to cylinders 103. The fuel storage source 152 includes, for example, an onboard fuel pump 154 which delivers fuel from the source 152 via a conduit 156 through a filter (not shown) to a common supply rail 158. The common rail 158 feeds fuel via respective fuel lines 160 to a plurality of fuel injectors 162, at least one per cylinder, and in this example, four injectors 162. The common rail 158 can also be connected via conduit 156 to a pressure regulator valve 164 which in turn is connected to conduit 166 to vent fuel vapor to the intake passage 104 when the pressure in the rail 158 exceeds a predetermined maximum pressure. The fuel pump 154 is operated through a relay or other suitable connection to controller 140.

A direct injector, as utilized herein, includes any fuel injection device that injects fuel directly into the cylinder volume, and is capable of delivering fuel into the cylinder volume when the intake valve(s) and exhaust valve(s) are closed. The direct injector 162 may be structured to inject fuel at the top of the cylinder. In certain embodiments, the direct injector 162 may be structured to inject fuel into a combustion pre-chamber. Each cylinder 103 may include one or more direct injectors 162. The direct injectors 162 may be the primary or the only fueling device for the cylinders 103, or alternatively the direct injectors may be an auxiliary or secondary fueling device for the cylinders 103. In certain embodiments, the direct injectors 162 are capable of providing the entire designed fueling amount for the cylinders 103 at any operating condition. Alternatively, the direct injectors 162 may be only partially capable, for example the direct injectors 162 may be capable of providing a designated amount of fuel for a specific purpose.

In still other embodiments, cylinders 103 include a port injector (not shown) in addition to or alternatively to direct injectors 162. In these embodiments, the intake manifold 105 may be divided, or the port fuel injectors may be positioned such that no other cylinder 103 in the system 100 is downstream of the port fuel injector, i.e. only the target cylinder is downstream of the respective port fuel injector.

The fuel injectors 162 may inject the fuel supply directly into each respective cylinder 103 or may supply fuel to the inlet valve ports, the injection timing being controlled the controller 140. During cylinder deactivation the supply of fuel to the cylinders 103 is cut off by individually disabling the respective fuel injectors 162 with the disablement being controlled by the controller 140 with a fuelling command which disables the fuel injection to one or more of the cylinders 103 while the nominal cylinders 103 fire normally, or are compensated with additional fuel and air flow to meet power demands.

The operation of the engine 102 is controlled by the controller 140 in response to vehicle operating conditions sensed by the sensors represented by sensor(s) 170. Controller 140 is connected to the fuel injectors 162, either indirectly as shown through fuel control module 142, or directly, to control the injector operation. The controller 140 can determine the injection timing and the injection period or pulse width. Under normal or nominal engine operating conditions, fuel is provided to all cylinders 103. Under an engine cranking condition, fuel may be provided to none, one or all of cylinders 103.

The fuel supply to the combustion chamber of each cylinder is controlled by a fuel control module 142 that is a separate controller or a part of controller 140. Fuel control module 142 operates the injectors 162 according to a fuel command produced by controller 140 in response to engine operating conditions. The controller 140 is connected to the fuel pump 154 and to a plurality of other engine condition sensors shown schematically as sensor 170. The engine condition sensors 170 may include, but are not limited to, sensors which monitor engine position, engine speed, manifold static pressure, mass air flow into the manifold, engine temperature, air temperature, cam shaft position (inlet and exhaust), inlet manifold tuning valves, barometric pressure, EGR amount, VGT position, torque demand, gear position, etc.

In certain embodiments, the system 100 includes a controller 140 structured to perform certain operations to control operations of engine 102. In certain embodiments, the controller 140 forms a portion of a processing subsystem including one or more computing devices having memory, processing, and communication hardware. The controller 140 may be a single device or a distributed device, and the functions of the controller 140 may be performed by hardware or software. The controller 140 may be included within, partially included within, or completely separated from an engine controller (not shown). The controller 140 is in communication with any sensor or actuator throughout the system 100, including through direct communication, communication over a datalink, and/or through communication with other controllers or portions of the processing subsystem that provide sensor and/or actuator information to the controller 140.

In certain embodiments, the controller 40, 140 is described as functionally executing certain operations. The descriptions herein including the controller operations emphasizes the structural independence of the controller, and illustrates one grouping of operations and responsibilities of the controller. Other groupings that execute similar overall operations are understood within the scope of the present application. Aspects of the controller may be implemented in hardware and/or by a computer executing instructions stored in non-transient memory on one or more computer readable media, and the controller may be distributed across various hardware or computer based components.

Example and non-limiting controller implementation elements include sensors providing any value determined herein, sensors providing any value that is a precursor to a value determined herein, datalink and/or network hardware including communication chips, oscillating crystals, communication links, cables, twisted pair wiring, coaxial wiring, shielded wiring, transmitters, receivers, and/or transceivers, logic circuits, hard-wired logic circuits, reconfigurable logic circuits in a particular non-transient state configured according to the module specification, any actuator including at least an electrical, hydraulic, or pneumatic actuator, a solenoid, an op-amp, analog control elements (springs, filters, integrators, adders, dividers, gain elements), and/or digital control elements.

The listing herein of specific implementation elements is not limiting, and any implementation element for any controller described herein that would be understood by one of skill in the art is contemplated herein. The controllers herein, once the operations are described, are capable of numerous hardware and/or computer based implementations, many of the specific implementations of which involve mechanical steps for one of skill in the art having the benefit of the disclosures herein and the understanding of the operations of the controllers provided by the present disclosure.

Certain operations described herein include operations to interpret or determine one or more parameters. Interpreting or determining, as utilized herein, includes receiving values by any method known in the art, including at least receiving values from a datalink or network communication, receiving an electronic signal (e.g. a voltage, frequency, current, or PWM signal) indicative of the value, receiving a software parameter indicative of the value, reading the value from a memory location on a non-transient computer readable storage medium, receiving the value as a run-time parameter by any means known in the art, and/or by receiving a value by which the interpreted parameter can be calculated, and/or by referencing a default value that is interpreted to be the parameter value.

Certain systems are described following, and include examples of controller operations in various contexts of the present disclosure. In certain embodiments, the controller 40, 140 interprets an engine cranking condition in response to one or more engine operating conditions, and in response to the engine cranking condition the controller 40, 140 provides a compression brake command that switches operation of intake valves 206 to a cam lobe 226' having a compression release brake profile and operation of their respective exhaust valves 208 to a fourth cam lobe 228' have a compression lift profile.

Figure 6:
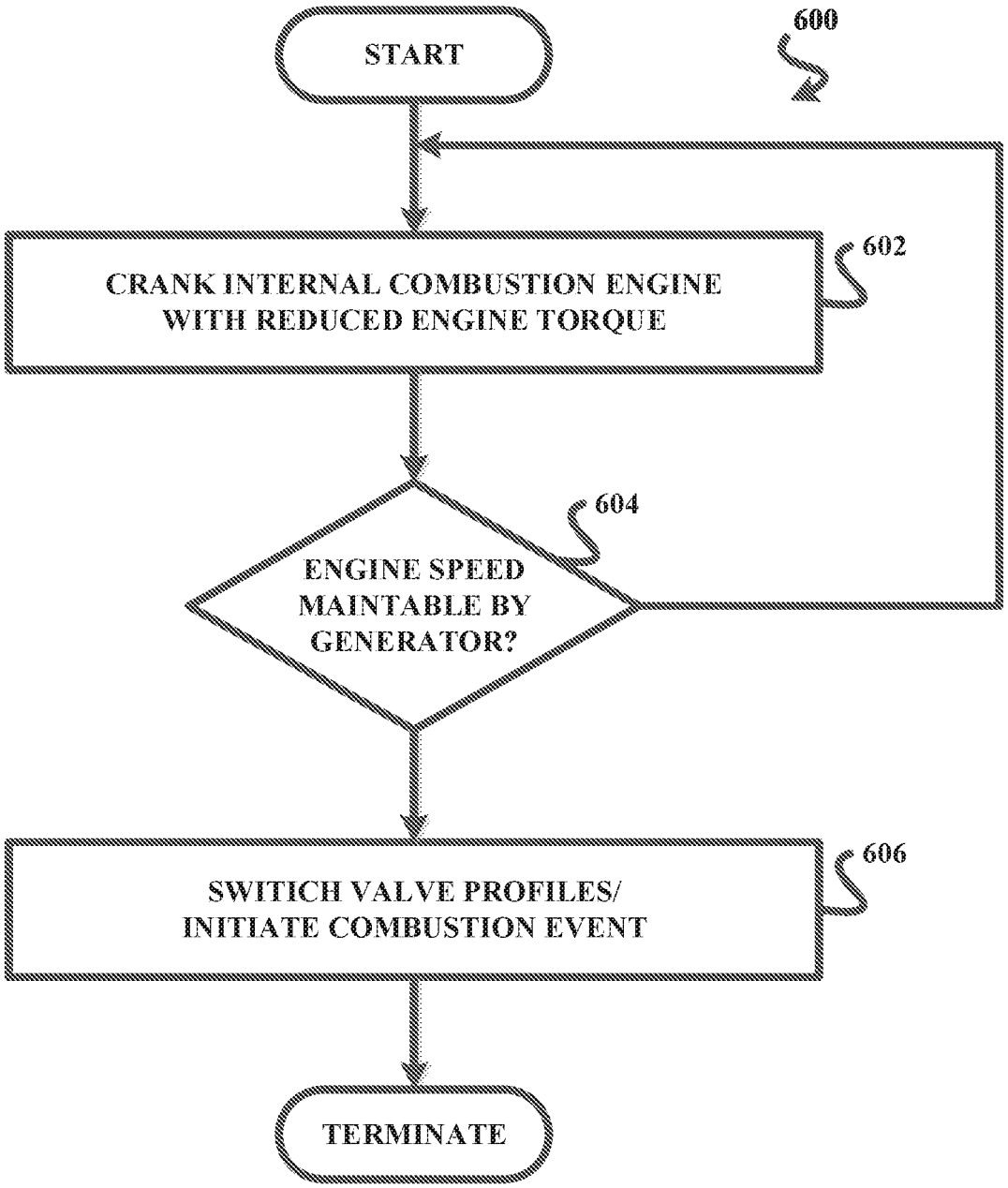
FIG. 6 is a flow diagram of a procedure for cranking an internal combustion engine.

Referring to FIG. 6, there is shown a flow diagram of a procedure 600 for cranking engine 102. Procedure 600 begins at operation 602 in which a cranking of engine 102 involves a reduction of torque required to turn engine 102 by a selectively opening the intake valves and/or the exhaust valves during an upstroke of pistons to reduce the work used to compress the gas in the cylinders.

As previously discussed, the valve train design is based on a compression brake and compression release valve profile, such as, for example, shown in FIG. 4. More particularly, the compression brake is achieved in one embodiment by the use of the profile switching valvetrain. The compression brake profile is offset significantly from the normal exhaust profile and has a shorter peak lift. The compression brake profile is shifted such that it starts to open shortly around TDC of the compression stroke or TDC of the power stroke (fuel or no fuel). This same profile may be used in combination with a cam phaser to move the profile to a compression stroke side of TDC to provide a compression release function. Due to the short peak lift of the exhaust brake profile, piston and head design may be made to accommodate this lift profile at peak lift at TDC.

An alternate option is to switch between the low lift (exhaust brake) and high lift (normal exhaust profile) to cross TDC and then phase the camshaft to the appropriate location such that peak lift for the brake profile is never seen at TDC.

A cylinder deactivation system may also be used to reduce cranking effort by deactivating all intake and exhaust valves so that there is no airflow through engine 102 and either an air spring or an empty cylinder is maintained during cranking until a desired speed is reached to active the valves. The cylinder deactivation system may be a switching valve train, which switches between a normal valve lift profile and a no lift profile. Further, a lost motion tappet or lifter design may be applied to each valve. The control maybe done in several ways, such as, for example, a deactivation of all valves at once or synchronously to accomplish a particular trapped charge target such as full cylinder or empty cylinder.

Returning to FIG. 6, at operation 604 is it ascertained if the engine 102 has achieved a speed whereby the motor generator is capable of maintaining engine speed with gas compression load. Operation 602 is continued until such time it is ascertained that the motor generator is capable of maintaining engine speed with gas compression load whereby at an operation 606 a compression event is initiated and combustion started on the appropriate compression cycle. The combination of the valvetrain which can release compression and a motor generator results in an engine architecture excluding a low speed starter.

Various aspects of the present disclosure are contemplated. According to one aspect, a system includes an internal combustion engine including a plurality of cylinders connected to an intake system and to an exhaust system, each of the cylinders including at least one intake valve, at least one exhaust valve and a piston. The system also includes a valve actuation mechanism connected to each of the plurality of cylinders. The valve actuation mechanism includes a lifting mechanism having a compression brake valve profile configured to selectively lift the exhaust valves in response to a cranking condition of the internal combustion engine, where the compression braking valve profile is phased to the upstroke of the pistons during the cranking condition.

In one embodiment, the system includes a motor generator structurally configured to maintain a specified cranking speed of the engine based on a gas compression load of the cylinders. In another embodiment, the system includes a phaser and, prior to the cranking condition of the internal combustion engine, the valve actuation mechanism is locked on the compression braking valve profile and the phaser is locked in a compression release position.

According to another aspect, a system includes an internal combustion engine including a plurality of cylinders connected to an intake system and to an exhaust system. Each of the cylinders includes at least one intake valve, at least one exhaust valve and a piston. The system also includes a valve actuation mechanism connected to each of the plurality of cylinders. The valve actuation mechanism includes a cylinder deactivation mechanism configured to deactivate the intake valves and the exhaust valves in response to the cranking condition of the internal combustion engine.

In one embodiment, the system includes a motor generator structurally configured to maintain a specified cranking speed of the engine based on a gas compression load of the cylinders. In another embodiment, prior to the cranking condition of the internal combustion engine, the cylinder deactivation mechanism has a cylinder deactivation profile configured to deactivate all the intake valves and the exhaust valves.

According to another aspect, a method includes cranking an internal combustion engine including a plurality of cylinders connected to an intake system and to an exhaust system, each of the cylinders including at least one intake valve and at least one exhaust valve; and in response to the cranking of the internal combustion engine, selectively lifting the exhaust valves based on a compression braking valve profile phased to the upstroke of the pistons.

In one embodiment, the method includes selectively lifting the intake valves and the exhaust valves based on normal combustion profiles in response to achieving a desired cranking speed of the internal combustion engine. In another embodiment, the method includes initiating a combustion event in response to achieving a desired cranking speed of the internal combustion engine.

While the invention has been illustrated and described in detail in the drawings and foregoing description, the same is to be considered as illustrative and not restrictive in character, it being understood that only certain exemplary embodiments have been shown and described. Those skilled in the art will appreciate that many modifications are possible in the example embodiments without materially departing from this invention. Accordingly, all such modifications are intended to be included within the scope of this disclosure as defined in the following claims.

In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

What is claimed is:

1. A system, comprising:

an internal combustion engine including a plurality of cylinders connected to an intake system and to an exhaust system, each of the cylinders including at least one intake valve, at least one exhaust valve and a piston; and a valve actuation mechanism connected to each of the plurality of cylinders, the valve actuation mechanism including a valve train assembly to operate the at least one intake valve and at least one exhaust valve in one of a normal valve profile and a compression brake valve profile, wherein the compression brake valve profile is configured to selectively lift the exhaust valve in response to cranking of the internal combustion engine, wherein the valve train assembly includes a phaser that phases the compression brake valve profile to an upstroke of the piston during the cranking until the internal combustion engine achieves a speed threshold for combustion, and wherein prior to the cranking of the internal combustion engine the valve actuation mechanism is locked on the compression brake valve profile with the phaser and switched from the compression brake valve profile to the normal valve profile when the internal combustion engine achieves the speed threshold for combustion.

2. The system of claim 1, further comprising:

a motor generator structurally configured to maintain a specified cranking speed of the engine based on a gas compression load of the cylinders.

3. The system of claim 1, wherein, prior to the cranking of the internal combustion engine, the valve actuation mechanism is locked on the compression brake valve profile with the phaser.

4. A system, comprising:

an internal combustion engine including a plurality of cylinders connected to an intake system and to an exhaust system, each of the cylinders including at least one intake valve, at least one exhaust valve and a piston; and a valve actuation mechanism connected to each of the plurality of cylinders, the valve actuation mechanism including a cylinder deactivation mechanism configured to deactivate the intake valves and the exhaust valves in response to a cranking of the internal combustion engine, wherein the cylinder deactivation mechanism closes the intake valves and the exhaust valves during the cranking so there is no airflow through the internal combustion engine until the internal combustion engine obtains a threshold speed.

5. The system of claim 4, further comprising:

a motor generator structurally configured to maintain a specified cranking speed of the engine based on a gas compression load of the cylinders.

6. A method, comprising:

cranking an internal combustion engine, the internal combustion engine including a plurality of cylinders connected to an intake system and to an exhaust system, each of the cylinders including at least one intake valve, at least one exhaust valve, and a piston, the internal combustion engine further including a valve actuation mechanism connected to each of the plurality of cylinders, the valve actuation mechanism including a valve train assembly to operate the at least one intake valve and the at least one exhaust valve in one of a normal valve profile and a compression brake valve profile;

operating the at least one intake valve, the at least one exhaust valve, and the piston based on one of the normal valve profile and the compression brake valve profile; and in response to the cranking of the internal combustion engine, selectively lifting the at least one exhaust valve based on the compression brake valve profile, wherein the valve train assembly includes a phaser that phases the compression brake valve profile to an upstroke position of the piston during the cranking, and prior to the cranking the valve actuation mechanism is locked on the compression brake valve profile with the phaser until a desired cranking speed of the internal combustion engine is achieved.

7. The method of claim 6, further comprising:

selectively lifting the at least one intake valve and the at least one exhaust valve based on the normal valve profile in response to achieving the desired cranking speed of the internal combustion engine.

8. The method of claim 6, further comprising:

initiating a combustion event in response to achieving the desired cranking speed of the internal combustion engine.

* * * * *